US006936781B2

(12) United States Patent
Quintanilla et al.

(10) Patent No.: US 6,936,781 B2
(45) Date of Patent: Aug. 30, 2005

(54) LOAD TERMINAL COVER

(75) Inventors: Alethia R. Quintanilla, Guadalupe (MX); Jesús B. Talavera, Antioch, TN (US); Renato V. Villasana, Guadalupe (MX); Francis Brown, Rochester, IN (US); Christopher Yager, Russiaville, IN (US)

(73) Assignee: Square D Company, Palatine, IL (US)

( * ) Notice: Subject to any disclaimer, the term of this patent is extended or adjusted under 35 U.S.C. 154(b) by 15 days.

(21) Appl. No.: 10/719,159

(22) Filed: Nov. 21, 2003

(65) Prior Publication Data

US 2005/0109596 A1 May 26, 2005

(51) Int. Cl.[7] ..... H01H 9/00
(52) U.S. Cl. ..... 200/304; 200/293; 335/202
(58) Field of Search ..... 200/1 R, 17 R, 200/18, 43.01, 43.22, 50.01, 50.02, 400, 200/50.32, 401, 50.33, 293, 50.37, 294, 303–307, 200/333, 334, 297; 335/202; 361/601–656; 439/715, 716

(56) References Cited

U.S. PATENT DOCUMENTS

| | | | | | |
|---|---|---|---|---|---|
| 4,461,939 | A * | 7/1984 | Sabisch et al. | ..... | 200/304 |
| 5,150,091 | A * | 9/1992 | Hart et al. | ..... | 335/202 |
| 5,304,761 | A * | 4/1994 | Rosen et al. | ..... | 218/157 |
| 5,880,927 | A * | 3/1999 | Kent et al. | ..... | 361/634 |
| 5,973,914 | A * | 10/1999 | Rose et al. | ..... | 361/627 |
| 6,121,562 | A * | 9/2000 | Green et al. | ..... | 200/304 |
| 6,541,722 | B1 * | 4/2003 | Whipple et al. | ..... | 200/293 |

* cited by examiner

*Primary Examiner*—Michael A. Friedhofer

(57) ABSTRACT

A load terminal cover assembly for use on circuit breakers installed in electrical enclosures. The assembly selectively limits access to circuit breaker load terminals and uninsulated portions of load conductors entering the load terminals when the enclosure cover assembly is removed.

20 Claims, 8 Drawing Sheets

FIG. 3
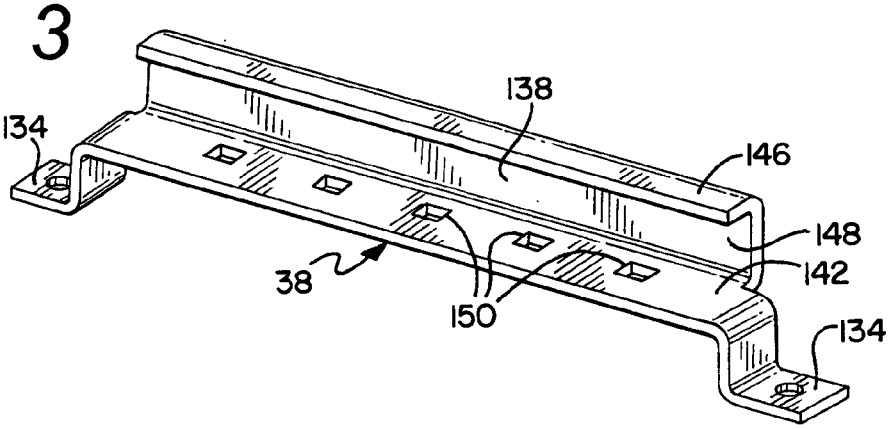
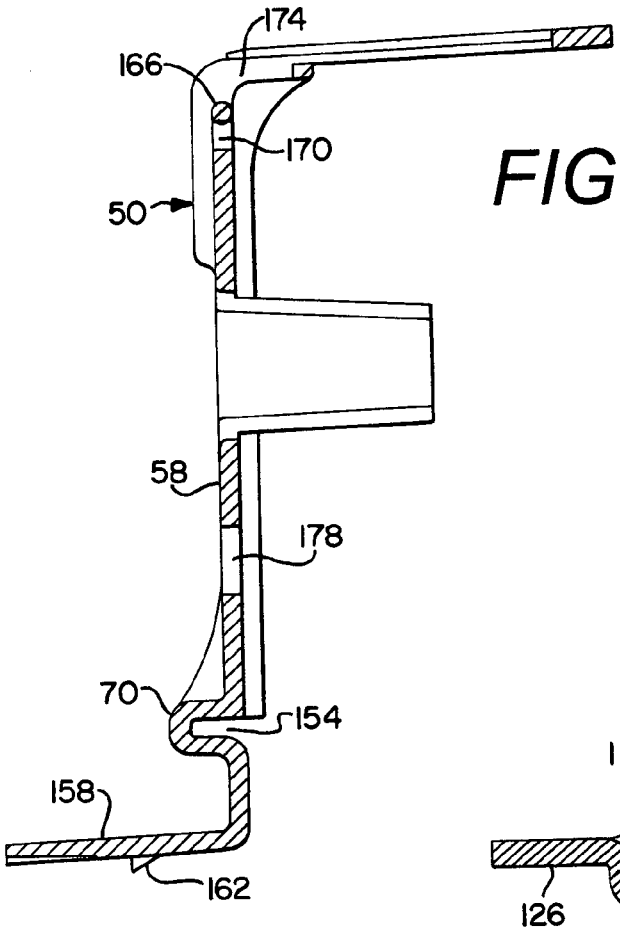
FIG. 4
FIG. 5
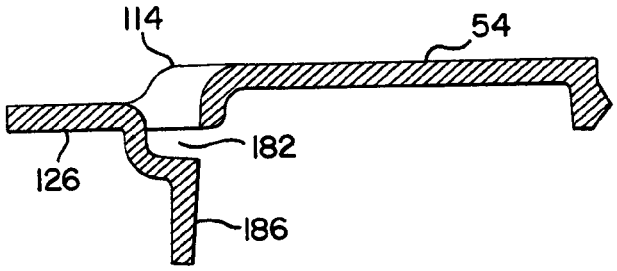

LOAD TERMINAL COVER

CROSS-REFERENCE TO RELATED PATENTS

Not applicable

STATEMENT REGARDING FEDERALLY SPONSORED RESEARCH OR DEVELOPMENT

Not applicable

FIELD OF THE INVENTION

The present invention relates to electrical panelboards, switchboards or other electrical enclosures for circuit breakers, and particularly to a circuit breaker load terminal cover assembly for use therein.

BRIEF DESCRIPTION OF THE DRAWINGS

The features of the invention will become more clearly understood from the following detailed description of the invention read together with the drawings in which:

FIG. 3 is a isometric view illustrating one embodiment of a mounting bracket constructed in accordance with the present invention.

FIG. 4 is a cross-sectional view illustrating in more detail certain features of the load terminal cover of FIGS. 1 and 2.

FIG. 5 is a cross-sectional view illustrating in more detail certain features of the load terminal closure of FIGS. 1 and 2.

Figure 1:
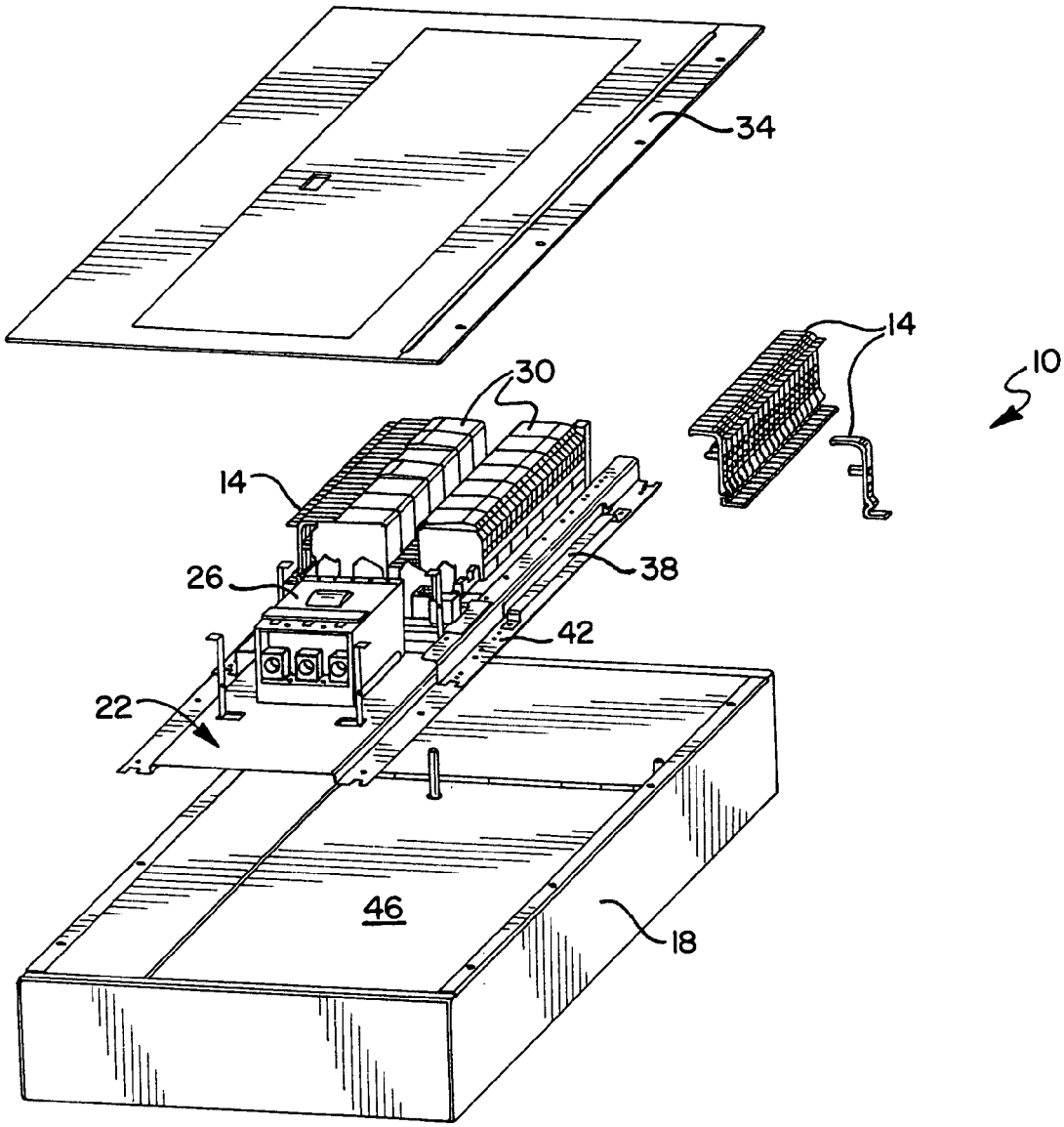
FIG. 1 illustrates an exploded view of an electrical enclosure for circuit breakers incorporating circuit breaker load terminal cover assemblies constructed in accordance with the present invention.

Before one embodiment of the invention is explained in detail, it is to be understood that the invention is not limited in its application to the details of construction described herein or as illustrated in the drawings. The invention is capable of other embodiments and of being practiced or being carried out in various other ways. Further, it is to be understood that the phraseology and terminology used herein is for the purpose of description and should not be regarded as limiting.

DETAILED DESCRIPTION OF THE DRAWINGS

FIG. 1 illustrates a typical panelboard, switchboard, load center or other electrical enclosure for circuit breakers, generally indicated by reference numeral 10, in which circuit breaker load terminal cover assemblies 14 of the present invention can be used. The electrical enclosure 10 generally includes a box like structure 18 that supports and encloses a panel interior 22, which can include a main breaker 26 or main lugs (not shown) and a number of branch circuit breakers 30. An enclosure cover assembly 34 completes the enclosure 10. The circuit breaker load terminal cover assemblies 14 are attached to a mounting bracket 38, which can be attached to a structural member 42 of the panel interior 22 or a back surface 46 of the box 18.

Figure 2:
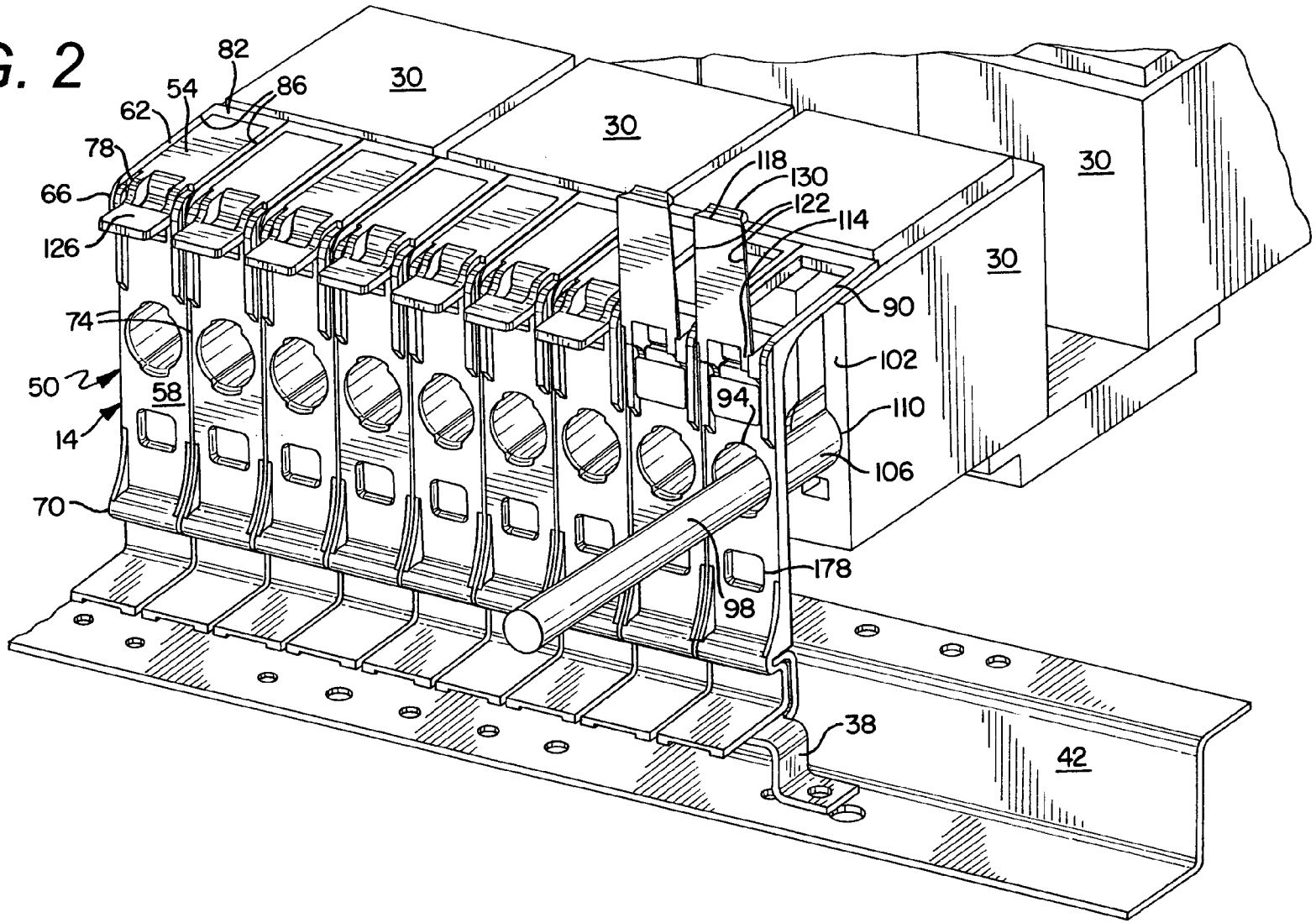
FIG. 2 is an isometric view of circuit breakers with circuit breaker load terminal cover assemblies constructed in accordance with the present invention installed.

FIG. 2 illustrates, in more detail, the installation and operation of the circuit breaker load terminal assemblies 14. Each load terminal cover assembly 14 includes a load terminal cover 50 and a load terminal closure 54. The load terminal cover 50 has a generally flat end wall 58, and a generally flat top 62. The end wall 58 is defined by a first end 66, a second end 70 and two generally parallel sides 74 intermediate the first and second ends, 66 and 70, respectively. The second end 70 of the end wall 58 is configured for attaching to the mounting bracket 38. The top 62 is defined by a first end 78, a second end 82, and two generally parallel sides 86. The top 62 defines a load terminal access aperture 90 for accessing the load terminal (not shown) of the branch circuit breaker 30. The end wall 58 defines a load conductor aperture 94 through which a load conductor 98 passes for connection to the circuit breaker load terminal. The first ends, 66 and 78, of the end wall 58 and top 62, respectively, are integrally connected such that the end wall 58 is approximately perpendicular to the top 62. The second end 82 of the top 62 is configured to be supportively engaged by a portion of a load end 102 of the branch circuit breaker 30 proximate the circuit breaker load terminal. Each of the two generally parallel sides 74 of the end wall 58 includes an integrally formed load conductor shield 106, which extend outwardly from and generally perpendicular to the end wall 58 in the same direction as the top 62. The two load conductor shields 106 are located adjacent the load conductor aperture 94 such that a load conductor 98 inserted into the load conductor aperture 94 is positioned between the two load conductor shields 106. The length of the load conductor shields 106 is such that a distal end 110 of each load conductor shield 106 will be proximate the load end 102 of the branch circuit breaker 30 when the circuit breaker load terminal cover assembly 14 is properly installed. Thus the load conductor shields 106 provide an electrically insulating barrier around any uninsulated portion of the load conductor 98 which might extend beyond the load end 102 of the branch circuit breaker 30. The closure 54 is generally flat and defined by a first end 114, a second end 118, and two generally parallel sides 122 extending between the first and second ends, 114 and 118, respectively. A handle 126 extends outwardly from the first end 114 and a latching nub 130 extends from the second end 118. The closure 54 is pivotably attached to the load terminal cover 50 for movement between a closed and an open position as shown.

FIG. 3 illustrates one embodiment of a mounting bracket 38 manufactured in accordance with the present invention. In this embodiment the mounting bracket 38 included an attachment foot 134 at each end for attaching to the structural member 42 of the panel interior 22 or the back surface 46 of the box 18. A longitudinal section 138 of the mounting bracket 38 has a generally hook-like cross-section defined by a long leg 142, a short leg 146 and an intermediate web 148. The long leg 142 defines apertures 150 at predetermined intervals along its longitudinal length.

FIG. 4 is a cross-sectional view illustrating in more detail certain features of the load terminal cover 50. As seen more clearly in this view, the second end 70 of the end wall 58 is configured for attaching to the mounting bracket 38. The cross-sectional shape of the second end 70 of end wall 58 is complementary to the hook-like cross-section of the mounting bracket 38 in that a slot 154 is provided for receiving the short leg 146 and a foot 158 is configured to mate with the long leg 142. A locking tab 162 extends from the bottom of the foot 158 and is positioned to be biasingly received in one of the apertures 150 such that the second end 70 of end wall 58 locks the load terminal cover 50 to the mounting bracket 38. From the cross-sectional view of the load terminal cover 50, it can also be seen that a pivot pin 166 is located generally at the juncture of end wall 58 and top 62. A closure retaining slot 170 is defined in the first end 66 of end wall 58 immediately adjacent the pivot pin 166, and a clearance aperture 174 is defined in the first end 78 of the top 62 immediately adjacent the pivot pin 166. The end wall 58 can also define a venting aperture 178 for permitting gasses generated by the branch circuit breaker 30 to pass through the end wall 58.

FIG. 5 is a cross-sectional view illustrating in more detail certain features of the load terminal closure 54. As seen more clearly in this view, the first end 114 also defines a pivot pin slot 182 and a retaining tab 186 extending from one end of the pivot pin slot 182 in a direction generally perpendicular to the handle 126.

Figure 6A:
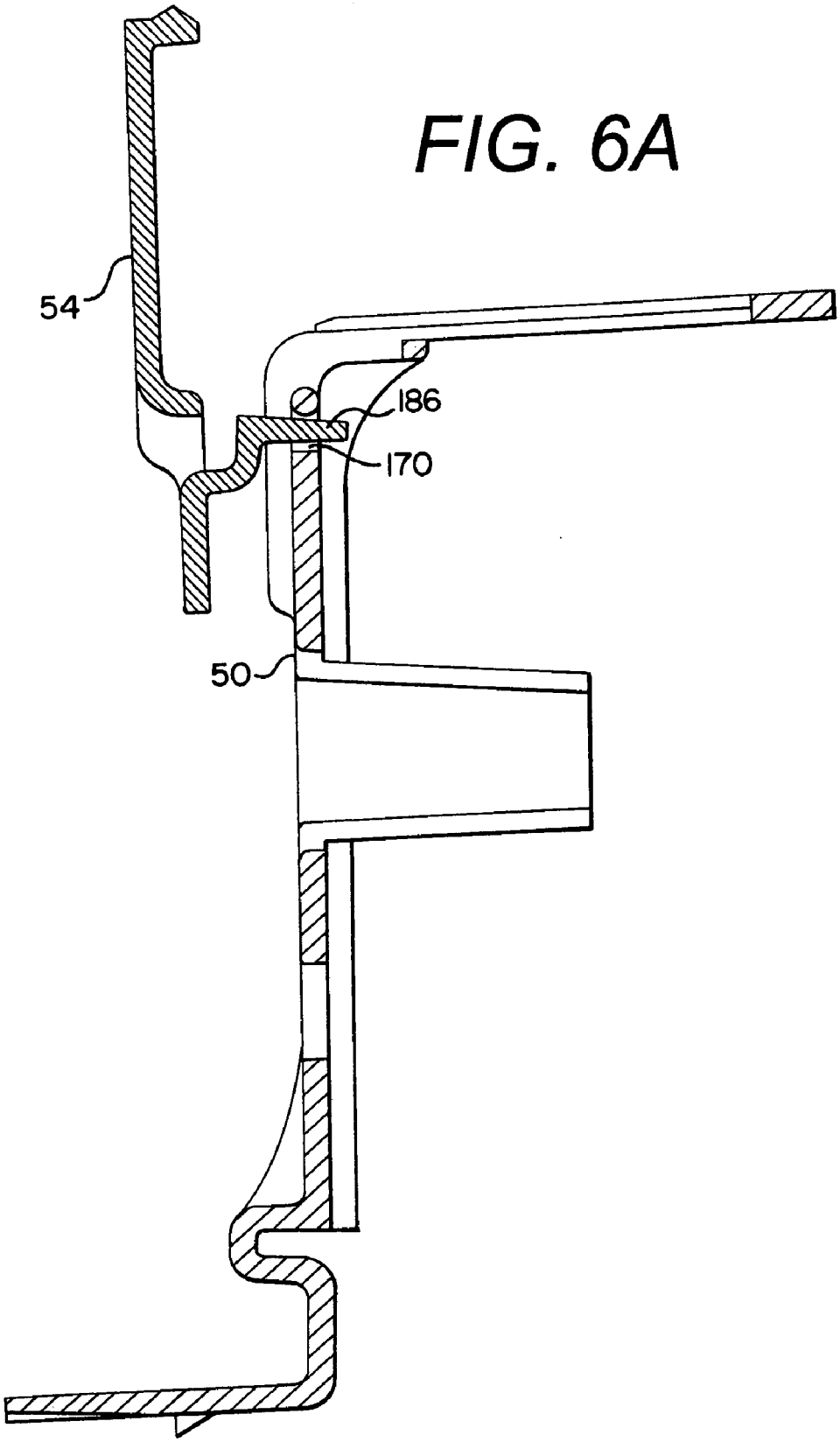
FIGS. 6A–6E are cross-sectional views illustrating the installation and operating positions of a circuit breaker load terminal cover assembly constructed in accordance with the present invention.
Figure 6B:
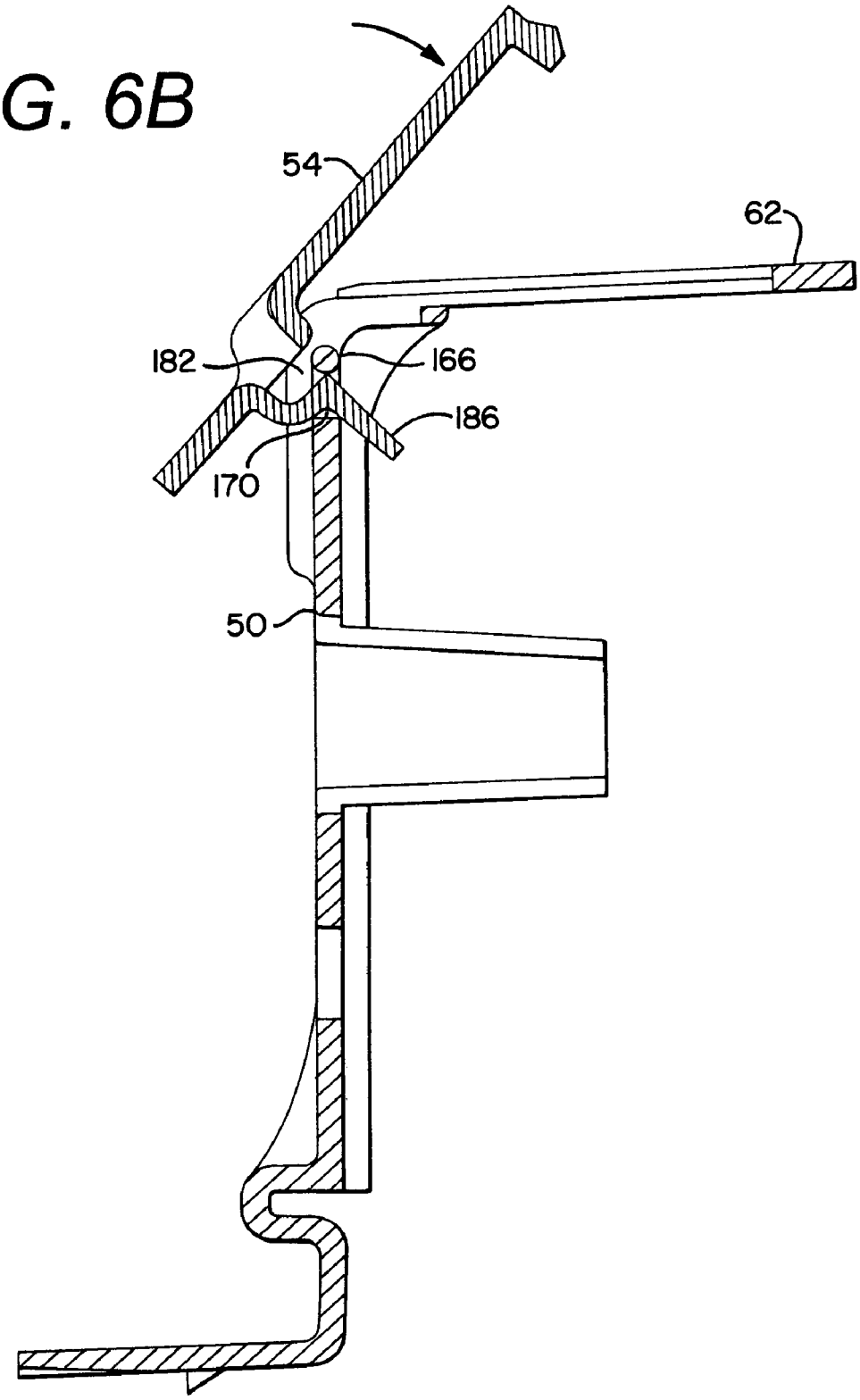
Figure 6C:
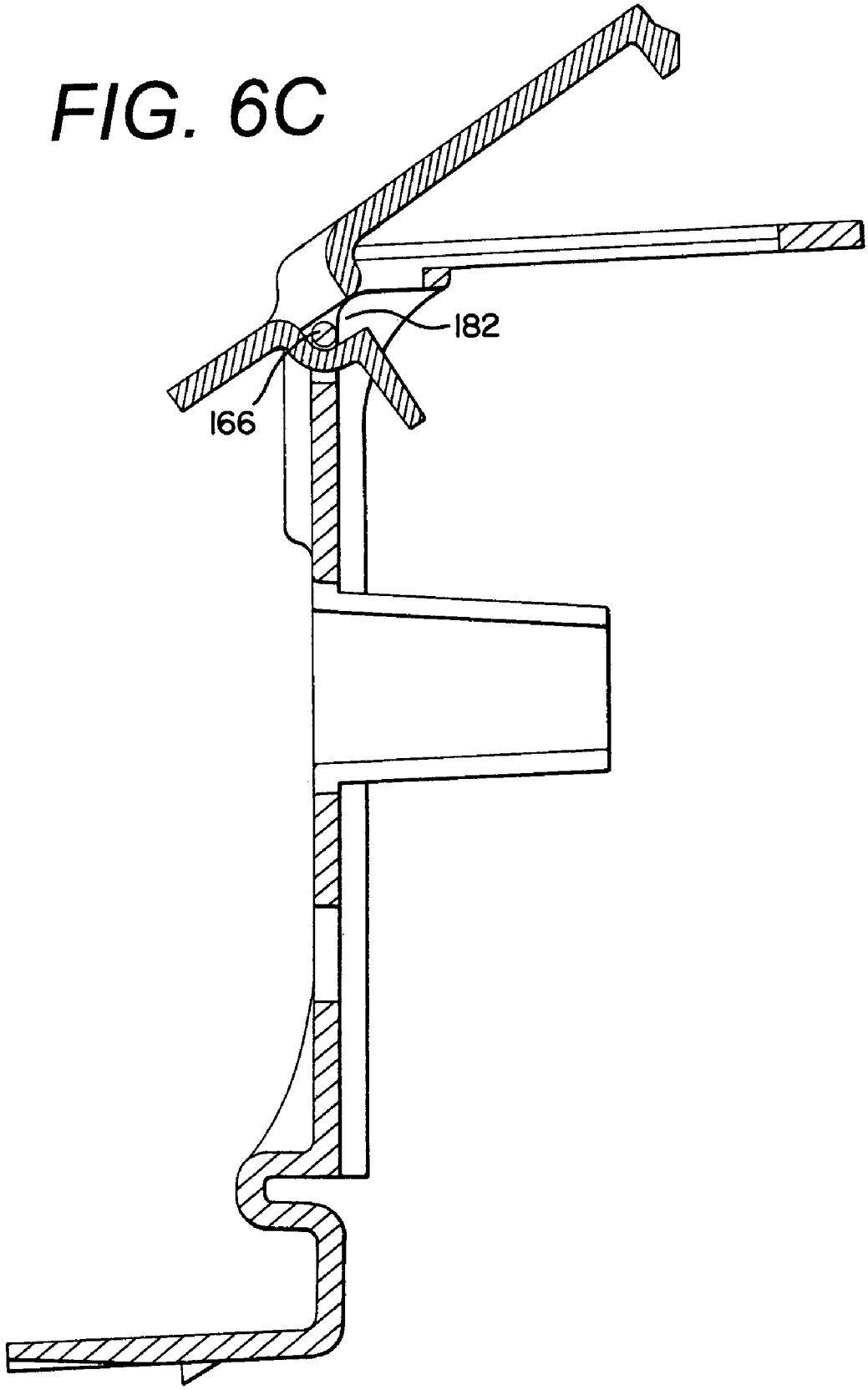

FIGS. 6A–6C illustrate in cross-section the installation of the load terminal closure 54 onto the circuit breaker load terminal cover 50. As shown in FIG. 6A, the load terminal closure 54 is held generally parallel to the circuit breaker load terminal cover 50, and the retaining tab 186 of the load terminal closure 54 is inserted into the closure retaining slot 170 of the circuit breaker load terminal cover 50. When the retaining tab 186 is fully inserted into the closure retaining slot 170, the load terminal closure 54 is rotated toward the top 62 of the circuit breaker load terminal cover 50 until the pivot pin 166 enters the pivot pin slot 182, as shown in FIG. 6B. At this point, the load terminal closure 54 is moved forward until the pivot pin 166 is fully inserted into the pivot pin slot 182, as shown in FIG. 6C.

Figure 6D:
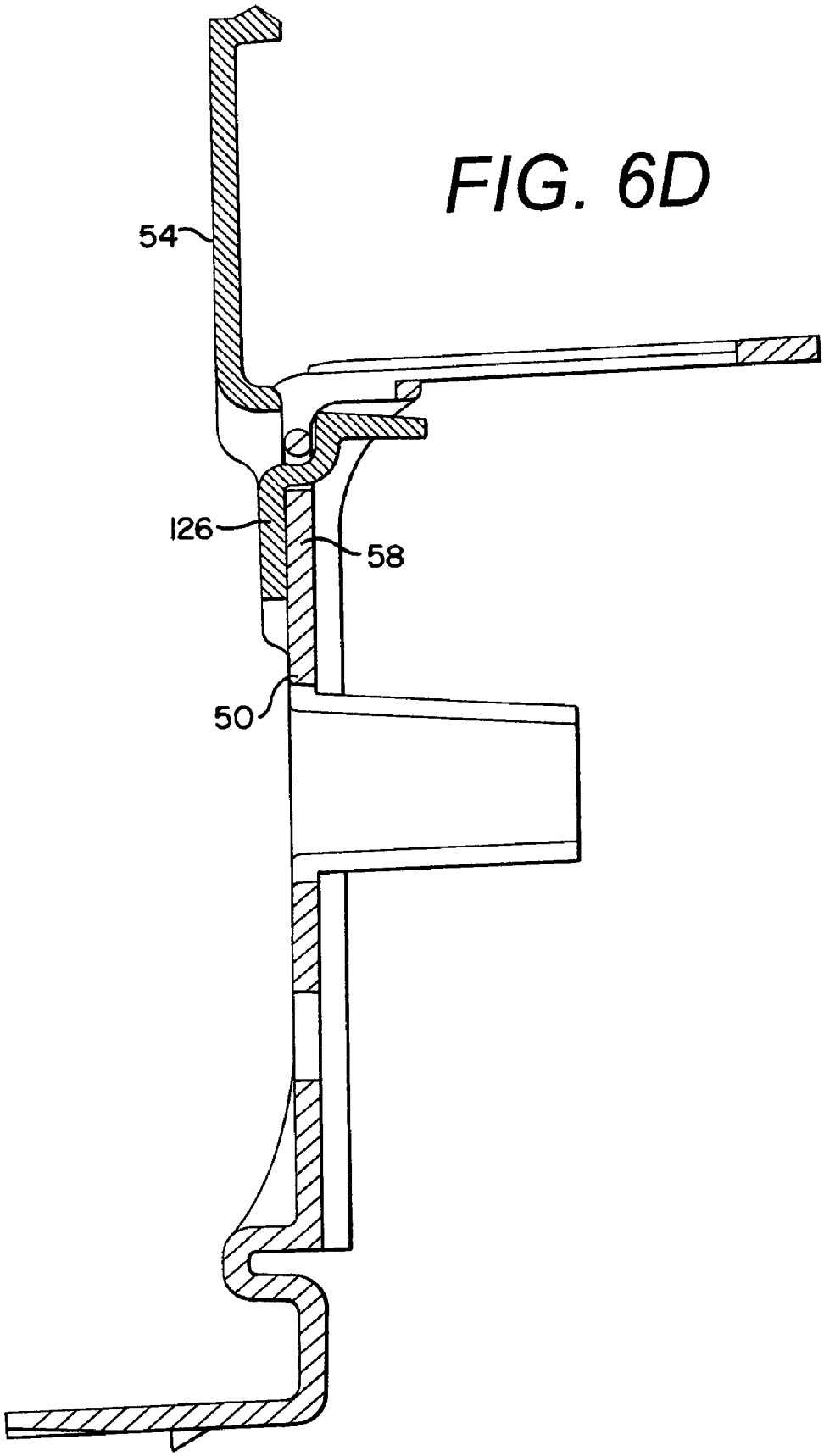

FIG. 6D illustrates in cross-section the load terminal closure 54 in its fully open position. In this position, the load terminal closure handle 126 engages the end wall 58 of the load terminal cover 50 and prevents further rotational movement.

Figure 6E:
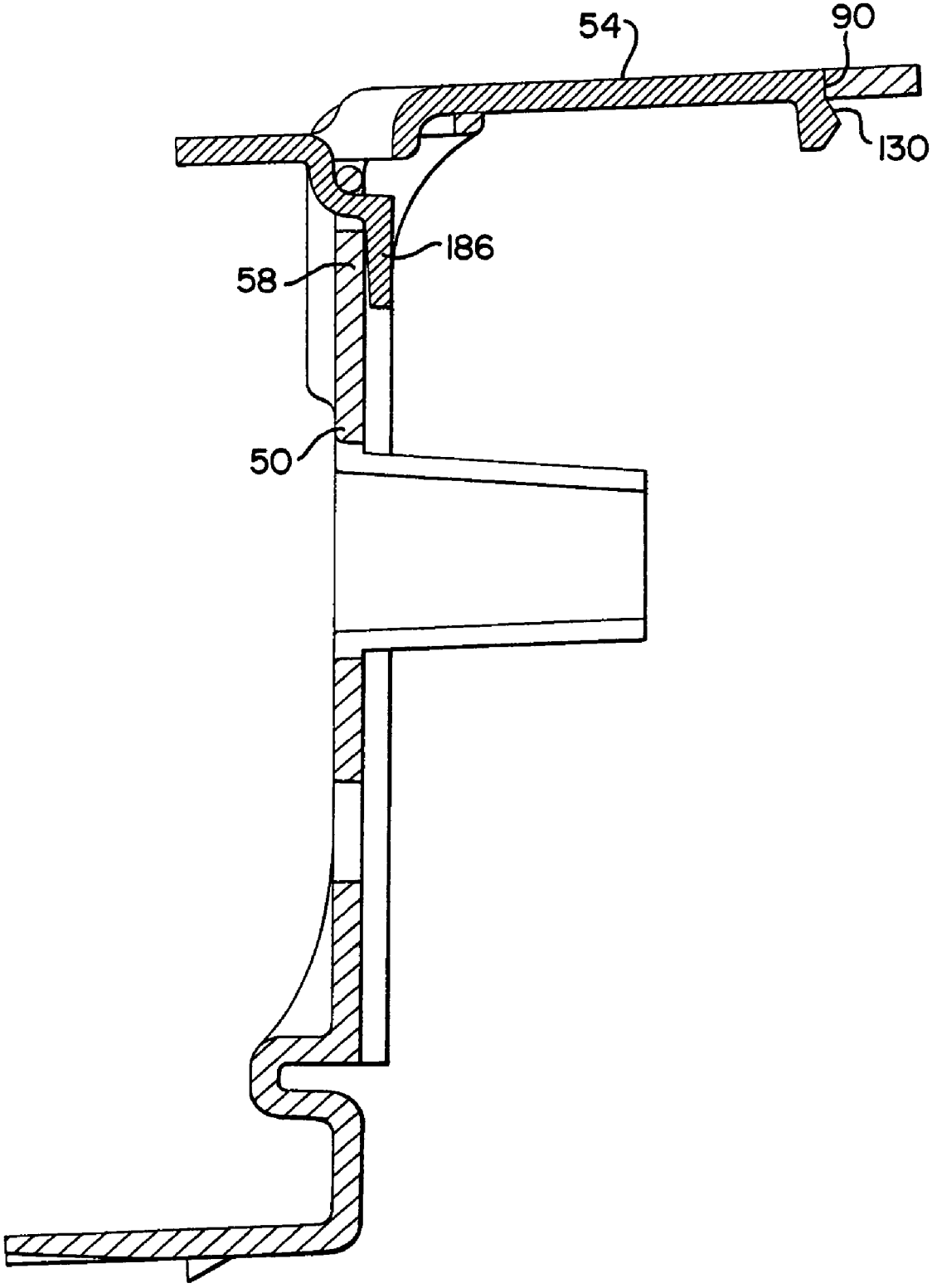

FIG. 6E illustrates in cross-section the load terminal closure 54 in its fully closed position. In this position, the load terminal closure latching nub 130 engages an end of the load terminal access aperture 90, and the retaining tab 186 engages an inside surface of the load terminal cover end wall 58, thereby holding the load terminal closure 54 in a closed position.

We claim:

1. A load terminal cover assembly for a circuit breaker installed in an electrical enclosure, said load terminal cover assembly comprising:

a mounting bracket attachable to a surface of the electrical enclosure;

a load terminal cover having an end wall and a top, said end wall defined by a first end, a second end and two generally parallel sides intermediate said first and second ends, said end wall defining an aperture intermediate said first and second ends for receiving a load conductor and an attachment means adjacent said second end for attaching said load terminal cover to said mounting bracket, said top extending generally perpendicularly from said first end of said side wall, said top being generally flat and defining an access aperture for accessing a load terminal of said circuit breaker; and, a load terminal closure, pivotably attached to said load terminal cover for selective movement between an access aperture closed position wherein access to said load terminal is prohibited and an access aperture open position wherein access to said load terminal is permitted.

2. The load terminal cover assembly of claim 1, wherein said end wall further defines two load conductor shields, each of said load conductor shields extending outwardly from and generally perpendicular to one of said two generally parallel sides mounting bracket includes a longitudinal section having an attachment foot at each end for attaching said mounting bracket to said surface of the electrical enclosure.

3. The load terminal cover assembly of claim 2, wherein said two load conductor shields are of a predetermined length such that at a distal end is proximate a load end of said circuit breaker when said load terminal cover is properly attached to said mounting bracket.

4. The load terminal enclosure assembly of claim 3, wherein said load conductor aperture is intermediate said load conductor shields such that said distal end of said load conductor shields prevent unintentional access to any uninsulated portions of said load conductor adjacent said circuit breaker load terminal.

5. The load terminal enclosure assembly of claim 1, wherein said mounting bracket includes a longitudinal section having an attachment foot at each end for attaching said mounting bracket to said surface of the electrical enclosure.

6. The load terminal enclosure assembly of claim 5, wherein said longitudinal section of said mounting bracket has a generally hook-like cross-section defined by a long leg, a short leg and an intermediate web.

7. The enclosure assembly of claim 6, wherein said long leg of said longitudinal section further define a plurality of apertures spaced at predetermined intervals along its length.

8. The enclosure assembly of claim 7, wherein said second end of said end wall of said load terminal cover defines a slot for receiving said short leg of said mounting bracket and locking tab for being snappingly engaged in one of said plurality of apertures of said long leg of said mounting bracket such so as to be attached thereto.

9. The enclosure assembly of claim 1, wherein a plurality of load terminal covers can be attached to said mounting bracket.

10. A load terminal cover assembly for a branch circuit breaker installed on a panel interior of an electrical enclosure, said load terminal cover comprising:

a mounting bracket attachable to a structural member of said panel interior;

a load terminal cover having an end wall and a top, said end wall defined by a first end, a second end and two generally parallel sides intermediate said first and second ends, said end wall defining an aperture intermediate said first and second ends for receiving a load conductor and an attachment means adjacent said second end for attaching said load terminal cover to said mounting bracket, said top extending generally perpendicularly from said first end of said side wall, said top being generally flat and defining an access aperture for accessing said load terminal of said circuit breaker; and, a load terminal closure, pivotably attached to a load terminal cover for selective movement between an access aperture closed position wherein access to said load terminal is prohibited and an access aperture open position wherein access to said load terminal is permitted.

11. The load terminal cover assembly of claim 10, wherein said end wall further defines two load conductor shields, each of said load conductor shields extending outwardly from and generally perpendicular to one of said two generally parallel sides.

12. The load terminal cover assembly of claim 11, wherein said two load conductor shields are of a predetermined length such that a distal end is proximate a load end of said branch circuit breaker when said load terminal cover is properly attached to said mounting bracket.

13. The load terminal enclosure assembly of claim 12, wherein said aperture for receiving said load conductor is intermediate said load conductor shields such that said load conductor shields prevent unintentional access to any uninsulated portions of said load conductor adjacent said branch circuit breaker load terminal.

14. The load terminal enclosure assembly of claim 10, wherein said mounting bracket includes a longitudinal section having an attachment foot at each end for attaching said mounting bracket to said surface of the electrical enclosure.

15. The load terminal enclosure assembly of claim 14, wherein said longitudinal section of said mounting bracket has a generally hook-like cross-section defined by a long leg, a short leg and an intermediate web.

16. The load terminal enclosure assembly of claim 15, wherein said long leg of said longitudinal section further define a plurality of apertures spaced at predetermined intervals along its length.

17. The load terminal enclosure assembly of claim 16, wherein said second end of said end wall of said load terminal cover defines a slot for receiving said short leg of said mounting bracket and locking tab for being snappingly engaged in one of said plurality of apertures of said long leg of said mounting bracket so as to be attached thereto.

18. The load terminal enclosure assembly of claim 10, wherein a plurality of load terminal covers can be attached to one said mounting bracket.

19. A load terminal cover assembly for a load terminal of a circuit breaker installed on a panel interior of an electrical enclosure, said load terminal cover comprising:

at least one mounting bracket attachable to said panel interior;

at least one load terminal cover having an end wall and a top, said end wall defining an aperture for receiving a load conductor, means for preventing access to uninsulated portions of said load conductor adjacent said circuit breaker load terminal and an attachment means for attaching to said mounting bracket, said top defining a load terminal access aperture for accessing said circuit breaker load terminal; and, a load terminal closure associated with said load terminal access aperture, said load terminal closure being attached to said end wall for selective pivotable movement between a closed position prohibiting access to said load terminal and an open position permitting access to said load terminal.

20. The load terminal cover assembly of claim 19, wherein said mounting bracket includes a longitudinal section having a hook-like cross-section defined by a long leg, a short leg and an intermediate web, said long leg defining a plurality of apertures, each said aperture being associated with a circuit breaker mounting position of said panel interior and said terminal cover defines an end configured to coincide with said long leg, said short leg and said intermediate leg of said mounting bracket and further includes a locking tab configured for snappingly engaging one of said plurality of aperture of said long leg of said mounting bracket for attaching said terminal cover thereto.

* * * * *